United States Patent [19]

Yost et al.

[11] Patent Number: 4,578,918

[45] Date of Patent: Apr. 1, 1986

[54] INSULATION ANCHOR

[75] Inventors: Richard J. Yost, Collingswood, N.J.; Terrence M. Smith, Washington Crossing, Pa.

[73] Assignee: Combustion Engineering, Inc., Windsor, Conn.

[21] Appl. No.: 528,673

[22] Filed: Sep. 1, 1983

[51] Int. Cl.[4] ..... E04B 1/38; F23M 5/00

[52] U.S. Cl. ..... 52/509; 52/410; 110/336; 269/53; 403/242

[58] Field of Search ..... 156/81, 91, 92; 269/53; 110/336; 24/657, 659, 680, 701, 590, 591; 248/274; 411/349; 403/242, 274; 52/364, 365, 383, 385, 410, 506, 509, 513, 698, 699, 766, 775, 583, 584, 585, 586, 587, 741, 747

[56] References Cited

U.S. PATENT DOCUMENTS

| | | | |
|---|---|---|---|
| 2,412,744 | 12/1946 | Nelson | 52/410 |
| 3,031,044 | 4/1962 | Stitt et al. | 52/410 |
| 3,167,342 | 1/1965 | Broyles | 24/701 |
| 3,229,335 | 1/1966 | Thome | 52/576 |
| 3,738,217 | 6/1973 | Walker | 52/506 |
| 3,960,460 | 6/1976 | Fischer | 52/585 |
| 4,336,086 | 6/1982 | Rast | 52/506 |
| 4,370,840 | 2/1983 | Bisbee et al. | 52/506 |
| 4,478,022 | 10/1984 | Wilkinson et al. | 52/509 |
| 4,494,295 | 1/1985 | Herring | 110/336 |

FOREIGN PATENT DOCUMENTS

| | | | |
|---|---|---|---|
| 516855 | 1/1953 | Belgium | 52/509 |
| 1019376 | 2/1966 | United Kingdom | 52/775 |

*Primary Examiner*—John E. Murtagh
*Assistant Examiner*—Andrew Joseph Rudy
*Attorney, Agent, or Firm*—Richard H. Berneike

[57] ABSTRACT

A system for insulating the walls of furnaces and other heated structures with ceramic fiber insulation including an improved insulation anchor. The anchor includes a pin which is attached to the furnace wall such as by stud welding with the pin having an elongated aperture at its outer end. A retaining rod extends through the aperture and into the adjacent ceramic fiber modules. The rectangular shaped rod includes an improved means for locking the rod in the aperture which comprises a crimp at about the midpoint of the rod. This provides a narrow section of the rod which permits the rod to be turned in the aperture and locked. The crimp method of forming the narrow section does not remove any metal from the rod and does not weaken the rod.

2 Claims, 5 Drawing Figures

INSULATION ANCHOR

BACKGROUND OF THE INVENTION

The present invention relates to means for securing insulation to a surface and more particularly to means for securing fiber insulation in the form of blankets and folded modules to the walls of furnaces or other heated structures such as kilns and soaking pits.

High energy costs in recent years has resulted in the increased use of insulation materials and furnaces and the like to save energy. High temperature ceramic fiber insulation materials which have been concurrently developed and have become readily available are increasingly being used for insulating furnaces in place of solid refractory materials such as fire brick. Ceramic fiber insulation is commonly formed in the manufacturing process into blankets of the desired thickness and width. The blankets can be used for insulating as flat blankets or may be folded into modules such as disclosed in U.S. Pat. No. 4,336,086.

Ceramic fiber insulation is normally installed in furnaces and the like by means of anchors which are attached to the furnace walls with the anchors piercing the insulation. When blankets are used, the anchors are usually some form of pin extending perpendicular to the furnace wall with the pin piercing the blanket and with some type of retaining means on the end of the pin. See for example U.S. Pat. No. 4,370,840. When modules are used, it is desirable and many times necessary to have some form of retainer which pierces the modules in a direction perpendicular to the folds in the module and parallel to the furnace wall. See for example the retaining means in the previously mentioned U.S. Pat. No. 4,336,086. In some situations it is desirable to use a combination of blanket and module insulation and it may further be desirable to include a layer of vapor barrier material within the insulation to prevent harmful furnace vapors from contacting the furnace wall.

One type of anchor which has been used comprises a pin which is secured to the furnace wall and has an elongated aperture near the outer end. A retaining rod adapted to pierce the fiber modules extends through the aperture and has means at about its midpoint adapted to interlock with the elongated aperture. The prior art technique for forming the interlock was to cut out opposed notches at about the midpoint of the rod. The configuration of the rod, the notches and the aperture was such that the rod could be inserted through the aperture up to the midpoint and then rotated 90° in the aperture past a slight interference fit to the locked position. The problem that arises from such an arrangement is that the cutout notches form a weak point in the rod.

SUMMARY OF THE INVENTION

The present invention relates to an improved insulation anchor and more particularly to an anchor having a pin attached to the wall of a furnace or the like with an elongated aperture near its outer end. A retaining rod extends through the aperture with the rod having a rectangular cross section and improved means for locking the rod in the aperture. The improved locking means is a crimped section at about the midpoint of the rod formed by squeezing or crimping the rod from the sides to reduce the long dimension of the rectangular cross section. This results in the rod bulging out in the other direction. The dimensions of the aperture, the rod and the crimp are such that the rod can be inserted through the aperture to the crimp and then rotated 90° to lock the rod in position.

DESCRIPTION OF THE PREFERRED EMBODIMENT

Figure 1:
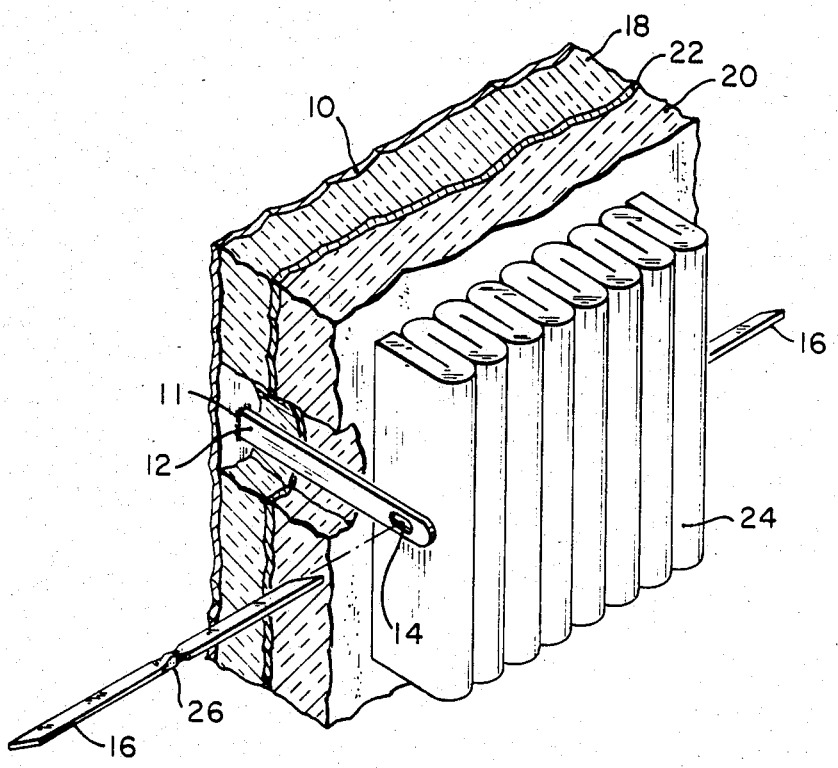
FIG. 1 is a perspective view of the anchoring of ceramic fiber blankets and a module to a furnace wall employing the anchoring means of the present invention.
Figure 2:
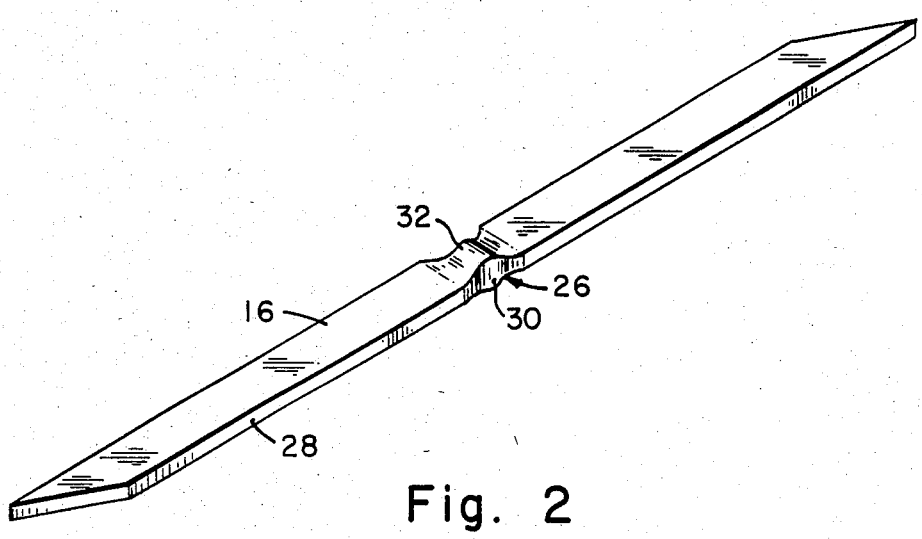
FIG. 2 is a perspective view of the rod portion of the present invention.
Figure 4:
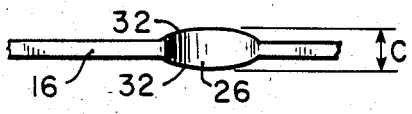
FIGS. 3 and 4 are top and side views respectively of the rod of the present invention.
Figure 3:
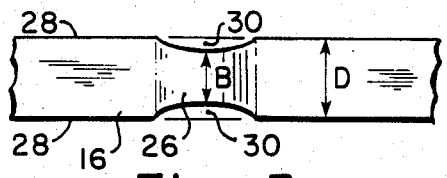
Figure 5:
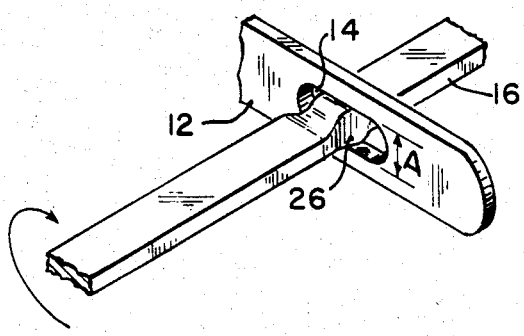
FIG. 5 is a perspective view of portions of the pin and rod in position to be turned and locked.

FIG. 1 of the drawings illustrate a wall 10 which may be the wall of a furnace or other heated structure. Attached to the interior, hot face of the furnace wall, such as by weld 11 (the furnace wall is normally metal), is a pin 12 with an aperture 14 at its outer end. This aperture is oblong as best shown in FIG. 5 to permit insertion and locking of the rod 16 as will be explained.

In the case where ceramic fiber blankets are to be used in conjunction with ceramic fiber modules, the blankets are first applied to the wall with the pin 12 piercing the blankets. For purposes of illustration of the invention, two ceramic fiber blankets 18 and 20 are shown in FIG. 1. Also shown in FIG. 1 is a layer of foil 22 between the two layers of blankets. This foil serves in a vapor barrier to protect the furnace wall from the migration of corrosive vapors. The vapor barrier is impaled over the pin 12 and placed between the blankets rather than over the second blanket to protect the vapor barrier to a greater degree from the furnace temperature.

Since the pin portion of the anchor means has a relatively small cross section, it is easy to install the blankets and vapor barrier. Also, the hole formed in the vapor barrier by the piercing action of the pin 12 is easily sealed by placing any suitable sealing around the pin to cover and seal the hole in the barrier.

Once the blankets and foil have been installed, the ceramic fiber module 24 may be installed. The module comprises a ceramic fiber blanket which has been repeatedly folded back on itself to form a continuous accordian folded module as shown in FIG. 1. An alternative procedure for forming the modules would be to use strips cut from a blanket and then edge stack the pieces together forming the module.

The modules 24 are positioned over the blanket 20 and positioned adjacent to and between the pins 12. For example, the module in FIG. 1 is located between the pin 12 which is shown and an identical pin which is located behind the module and not seen in FIG. 1. After the modules have been properly aligned, the rod 16 is inserted through the oblong aperture 14 and into the module until the crimped section 26 of the rod lines up with the aperture 14. The rod is then rotated 90° so that the crimp is locked into the aperture. The next module would then be impaled over the free end of the rod 16 and placed in position between pins 12 ready for insertion of the next rod 16. It should be noted that the modules are oriented such that the rods 16 pass through the layers of the module and not into the ends. Also, it would be normal that each module would have four or more pins and rods for anchoring purposes although only two have been shown in FIG. 1.

The notched rod 16 of the present invention is a flat rod having a rectangular cross section. The notch is formed by squeezing or crimping the rod from its sides 28 with suitable dies to indent the sides as at 30 and to form the material to bulge out on the top and bottom as at 32. By this technique, a notch is formed in the side edges 28 without removing any of the rod material. Therefore, the rod is stronger at the crimp then it would be if a lock was formed by cutting out notches.

The dimensions of the aperture 14 and the rod 16 are such that the rod may be easily inserted through the aperture until the crimp coincides with the aperture. The dimension of the bulges 32 are maintained small enough to permit the insertion. When the rod is in position as illustrated in FIG. 5, it is rotated 90° so that the indentation 30 now faces the sides of the aperture. Since the width of the rod 16 is greater than the width of the aperture, the rod is now locked in position and prevented from longitudinal movement. To be more specific, the width dimension "A" of the aperture 14 is greater than the width dimension "B" of the indented torsion of the crimp 26 and the height dimension "C" of the bulge 32. The dimension "A" is less than the width dimension "D" of the rod 16. The dimensions are preferable such that there is an interference fit when the rod is rotated so that it will be locked firmly in place and prevented from freely rotating back to the unlocked position.

We claim:

1. In a high temperature insulation construction wherein ceramic fiber insulation modules are secured to a surface by anchor means and wherein the anchor means includes a pin projecting generally perpendicular to said surface and having one end of said pin attached to said surface and the other end of said pin being remote from said surface, an oblong aperture in the pin adjacent the end remote from the surface and a retaining rod adapted to be inserted through the aperture into the ceramic fiber insulation module and locked in position relative to the pin, said rod having two short sides and two long sides thereby forming a rectangular cross section, the improvement comprising locking means on said rod for locking said rod in said aperture comprising a crimped portion at about a center of said rod, said crimped portion formed without removing any rod material by pressing the rod from opposite short sides whereby said short sides are pressed inwardly to form an indented portion and said long sides are caused to bulge outwardly to form a bulge portion.

2. In a high temperature insulation construction as recited in claim 1 wherein said oblong aperture (14) has a predetermined width (A) and wherein the width of said indented portion (B) and a height of said bulge portion (C) of said crimped portion (26) are both less than said predetermined width (A) and said rod has a width (D) greater than said predetermined width (A).

* * * * *